United States Patent [19]

Cornwell

[11] Patent Number: 4,634,958

[45] Date of Patent: Jan. 6, 1987

[54] TRANSFORMER UTILIZING SELECTIVELY LOADED REACTANCE TO CONTROL POWER TRANSFER

[75] Inventor: Lionel B. Cornwell, Madison, Conn.

[73] Assignee: Intermag Incorporated, Madison, Conn.

[21] Appl. No.: 588,680

[22] Filed: Mar. 12, 1984

[51] Int. Cl.[4] ..... G05F 7/00

[52] U.S. Cl. ..... 323/255; 336/144

[58] Field of Search ..... 323/208, 209, 232, 255, 323/258, 343, 346, 361, 356, 364, 253; 336/144

[56] References Cited

U.S. PATENT DOCUMENTS

| | | | |
|---|---|---|---|
| 1,140,920 | 5/1915 | Sieber | 336/144 |
| 3,353,094 | 11/1967 | Wentworth | 323/262 |
| 3,938,030 | 2/1972 | Cornwell | 323/253 |

*Primary Examiner*—Patrick R. Salce

*Assistant Examiner*—D. L. Rebsch

*Attorney, Agent, or Firm*—McCormick, Paulding & Huber

[57] ABSTRACT

Apparatus for controlling power transfer in an electrical induction device uses a controlled reactance to regulate the power transferred from an alternating current power source to a load without distorting or degrading the transferred power waveshape. The apparatus includes a power transformer having a power core and a primary coil and a secondary coil each encircling the power core. A number of control cores, separate from the power core, have associated control coils which are selectively short-circuited to provide the controlled reactance. The primary coil is arranged to encircle the control cores and coils and the secondary coil so that the primary coil is subject to the controlled reactance of the control cores.

12 Claims, 14 Drawing Figures

TRANSFORMER UTILIZING SELECTIVELY LOADED REACTANCE TO CONTROL POWER TRANSFER

BACKGROUND OF THE INVENTION

This invention relates generally to controlled power transferring devices and deals more particularly with apparatus for controlling the transfer of power in an electrical induction device from a power source to a load without distorting or degrading the transferred power waveshape. More specifically, the present invention deals with power transferring devices of the type having a core selectively loaded by a variable reactance to control the power transfer.

It is often desirable to control or regulate the supply of alternating current electric power to a load under varying source power and varying load conditions. In some cases, such as, for example, where a load device is powered by a commercial, 60 Hertz power source, proper device operation is dependent upon the presence of a sinusoidal voltage having a nominal magnitude of typically 110 volts. When the magnitude of the voltage rises above or falls below the nominal value, inefficient or improper load operation may occur. In other instances, such as, for example, those occuring during a brownout when the source power drops well below the desired nominal value, actual damage may occur to the load device being powered. Consequently, a need exists for a power transferring device which provides a sinusoidal output voltage to power a load and additionally maintains output voltage regulation over a wide range of source power variations.

In certain other cases, it is desirable to control or regulate the supply of alternating current electric power to a load in response to a command signal from a device sensing for example, such parameters as voltage, current, temperature, humidity, motor speed or other such similar parameters. In these cases, a control circuit of some type generally cooperates with a feedback signal generated by the sensing device to regulate the power transfer.

Unlike many previously used regulating devices employing transformers, magnetic circuits and the like, the regulating characteristics of the present invention are not dependent upon operation along a specific portion of the power transferring device's B-H curve. Consequently, a particular shaped B-H curve and selection of the proper amount and type of core material is not critical in the present invention to provide regulation.

Still other applications, such as those relating to high voltage power transmission and distribution require that the output alternating current electric power waveshape remain sinusoidal and the magnitude of the output power provided to a user, such as a household or factory, remain constant over a wide range of load variations. When a heavy demand for power is made on power companies, more current flows in the power distribution lines. The increased current causes a higher voltage drop in the distribution lines, and consequently lowers the magnitude of the voltage provided to a user. The power companies generally compensate for the lower voltage at the user end of the distribution line by increasing the magnitude of the voltage provided at the source end of the distribution line. The increased voltage is often obtained by mechanically moving taps on a power distribution transformer or the like to control the power transfer to the distribution line to maintain the magnitude of the voltage provided to a user within predetermined limits. The power transferring device of the present invention does not require moving parts to control power transfer to increase or decrease the output voltage.

One previously used power transferring arrangement controls the rate of electric power transfer in an electrical induction device such as a transformer, by loading a core with a variable reactance produced by selectively short circuiting and open-circuiting a control coil at a predetermined time. This arrangement has the advantage of controlling large amounts of power with relatively low power handling control and circuit components. Generally, arrangements of this type achieve power transfer control by varying the time and accordingly the amount of power that is transferred to a load. The power transfer time control is often accomplished by using a phase shift control circuit to activate a short-circuiting switch means, such as an SCR or the like, at a predetermined phase angle during each alternating current electric cycle. A feedback means or manual adjustment cooperates with the phase shift control circuitry to select the phase angle. Such an arrangement is illustrated and described in my U.S. Pat. No. 3,938,030 entitled "Controllable Power Transferring Device Utilizing a Short-Circuited Controlled Reactance", issued Feb. 10, 1976.

Although the arrangement described in the above referenced patent is able to provide efficient power transfer and control, it has the disadvantage that the input power waveform is not preserved during the power transfer, and consequently, the transferred power waveform is distorted.

A general aim of the present invention is to provide apparatus for controlling the transfer of power from a power source to a load that overcomes the limitations of previously used power transferring devices.

Another aim of the present invention is to provide a power transferring device that does not distort or degrade the waveshape of the alternating current transferred power.

A further aim of the present invention is to provide a power transferring device that is self-regulating over a wide range of source power and load variations.

Other features and advantages of the present invention will be apparent from the following written description and the drawings forming a part thereof.

SUMMARY OF THE INVENTION

In accordance with the present invention, apparatus is provided for controlling the transfer of power in an electrical induction device. The device has a plurality of coils arranged to induce an electrical current in a first coil when an electrical potential is impressed across the second coil. Means are provided for sensing the power delivered to the first coil.

The invention further resides in means for providing a reactance. Means responsive to the sensing means selectively couple the reactance means to the second coil to control the power transfer from the second coil to the first coil without distorting or degrading the waveshape of the electrical potential impressed across the second coil.

Figure 1:
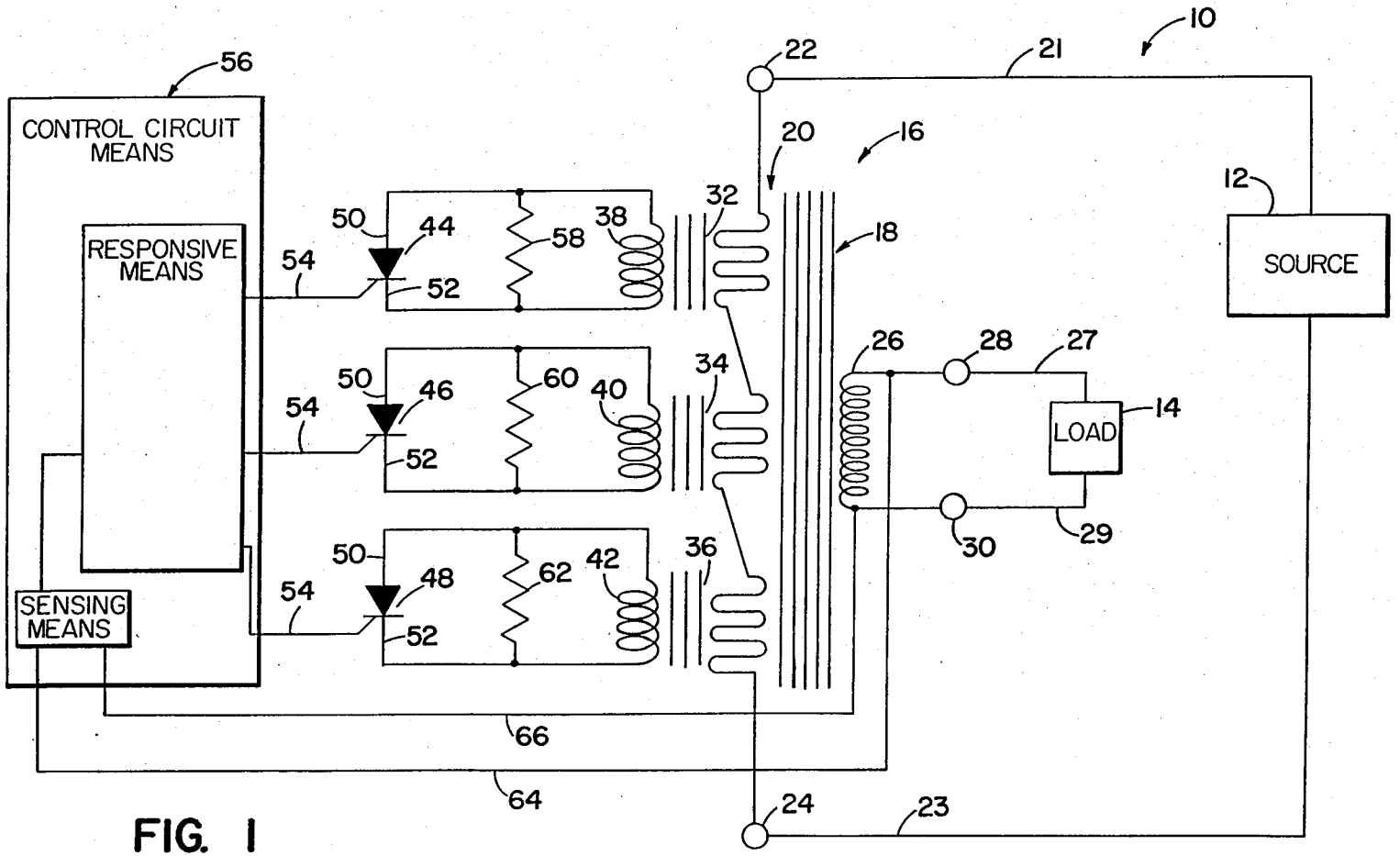
FIG. 1 is a diagram partly in schematic form and partly in block diagram form illustrating a power transferring apparatus in accordance with the present invention arranged for self-regulation.

FIGS. *6a–6g* illustrate voltage, current and timing waveforms at selected points in the circuitry of the apparatus illustrated in FIG. 1.

Figure 7:
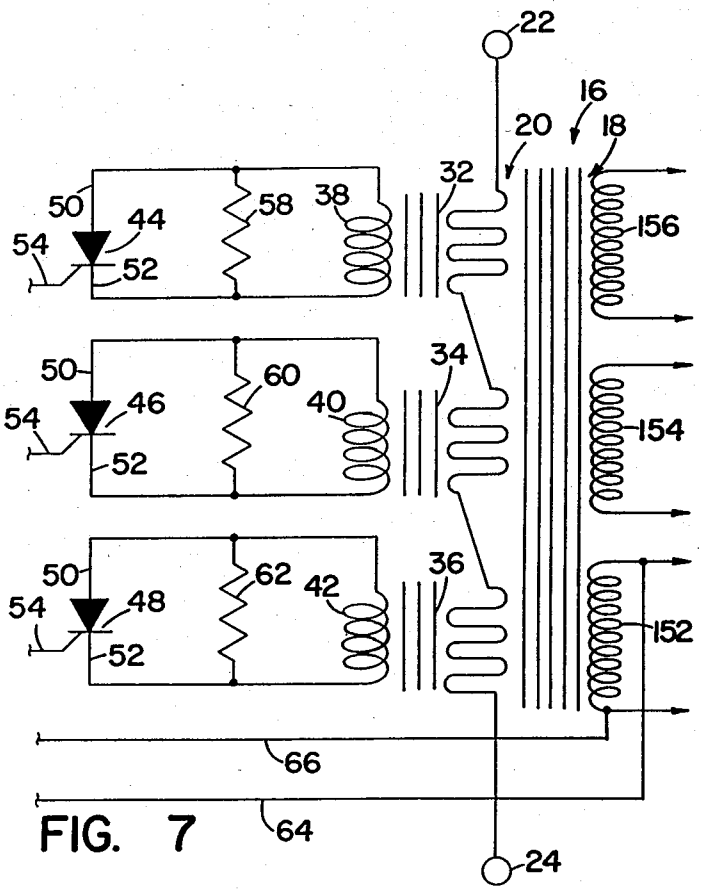

FIG. 7 shows in schematic form another embodiment of the present invention wherein the power transferring device is arranged with multiple output voltage windings.

Figure 5:
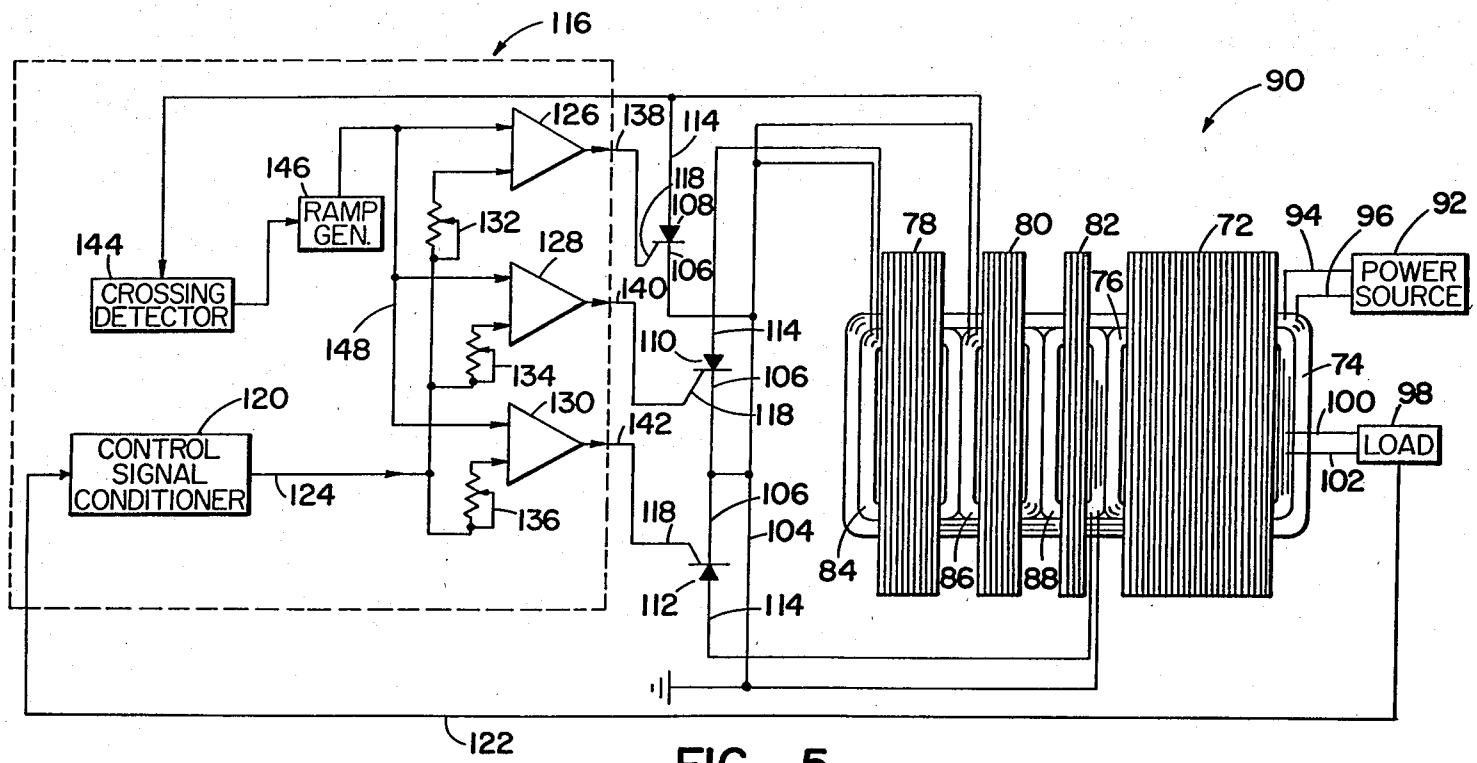
FIG. 5 is a diagram partly in schematic form and partly in block diagram form illustrating another embodiment of power transferring apparatus arranged for controlling power transfer in response to a control signal.
Figure 8:
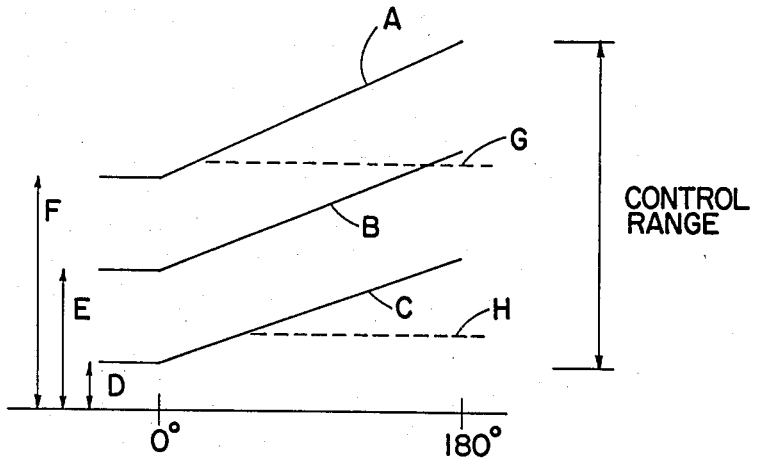

FIG. 8 illustrates timing control voltage ramps associated with the control circuit of the power transferring apparatus of FIG. 5.

DETAILED DESCRIPTION

Referring now to the drawings, apparatus embodying the present invention and for controlling the power transfer from a power source to a load is designated generally by the numeral 10 and is illustrated partially in schematic form and partially in block diagram form in FIG. 1. The power transferring apparatus 10 is arranged for self-regulation to control the power transfer from a power source such as an alternating current electric power source 12 to a load device 14 such as, for example, a motor, an instrument, a heater, electrical circuitry, or other such power consuming device or element operating from an alternating current power source under varying power source and load conditions. The power transfer is regulated or controlled without distorting or degrading the power source voltage waveshape. Thus, if the input power source voltage waveshape is a sinusoid, the waveshape of the transferred electrical power will be a sinusoid.

The apparatus 10 may be used to control the transfer of power from any type of alternating current power source and for purposes of explanation and illustration, a commercial 60 Hertz alternating current electrical power source such as that which provides power to households and the like will be used in the present disclosure. It will be understood however, that the apparatus 10 may transfer power from power sources producing power with frequencies ranging from 25 Hertz to approximately 400 Hertz and thus may accommodate European and other power distribution standards. It will also be understood that the apparatus 10 may operate with power source voltages ranging from low voltages of approximately 1 volt to very high voltages such as those found in power transmission applications and ranging in the several hundreds of thousand volts. The voltage handling capacities of the power transferring apparatus 10 are only limited by limitations in the currently available construction and electrical insulating materials, such as, for example, the dielectric strength of insulating material used to prevent electrical conductors shorting together when carrying high voltages.

Figure 2:
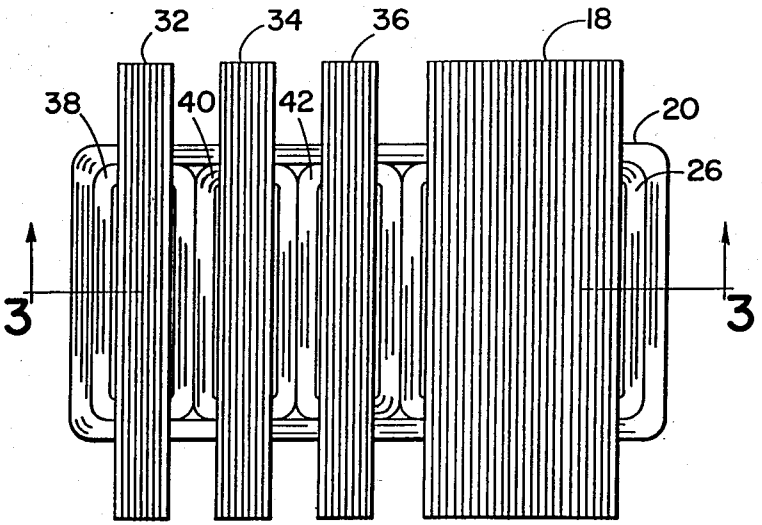
FIG. 2 is a top plan view of the power transferring device of FIG. 1 wherein in the control cores have the same cross-sectional area.

Considering now the invention in further detail and referring to FIGS. 1 and 2, the power transferring apparatus 10 comprises an electrical induction device such as a power transformer designated generally at 16. The power transformer 16 includes a power core 18 of a magnetic material, a primary winding or coil 20 encircling the core 18 and connected to the alternating current power source 12 by leads 21, 23 connected to primary coil terminals 22,24. A secondary winding or coil 26 encircles the power core 18 and is connected to the load 14 by leads 27, 29 connected to secondary terminals 28, 30. The power core 18, primary coil 20 and the secondary coil 26 form a conventional transformer designed in accordance with accepted transformer design standards and principles. Accordingly, the transformer 16 may be a step-up, step-down or one-to-one power ratio transformer or other transformer types.

The power transferring apparatus 10 further includes a number of control cores 32, 34, 36 and associated control coils 38, 40, and 42 respectively. The control cores 32, 34, 36 are made of a magnetic material and are separate and independent from the power core 18. The magnetic material used for the power core 18 and control cores 32, 34, 46 may be of different materials, to alter time response characteristics to compensate for voltage input and load variations; however, the magnetic material used in the power and control cores is preferably of the same material. The control coils 38, 40, 42 encircle their respective control cores 32, 34, 36, and each coil is connected across a controllable short-circuiting means 44, 46, 48 respectively.

Primary coil 20 in accordance with the present invention also loops or encircles the control coils 38, 40, 42 and their associated control cores 32, 34, 36 respectively. It may be necessary or desirable for the secondary coil 26 to encircle the coils and cores and the primary coil in certain instances relating to manufacturing such as, for example, to facilitate the locating and placement of desired taps. The operation of the power transferring apparatus is in either configuration the same and as described in detail hereinbelow.

Still referring to FIGS. 1 and 2, the power transferring apparatus 10 operates as follows. In normal transformer operation, a current flows through the primary winding 20 when a power source 12 is connected across primary terminals 22, 24 to create a magnetic field in the power core 18. The magnetic field in the power core 18 in turn induces a voltage across the secondary winding 26 which tends to cause a current to flow through the secondary winding and through a load 14 connected across terminals 28,30. However, in the present invention primary winding 20 is also subject to a controlled reactance which influences the amount of power that is transferred from the primary winding to the secondary winding and consequently the magnitude of the voltage produced across the secondary winding 26.

The controllable short-circuiting means could be any of a number of circuit elements or devices such as, for example, as illustrated in FIG. 1, a silicon controlled rectifier (SCR). The SCR illustrated in FIG. 1 is a three terminal device having its anode 50 connected to one end of its respective control coil and its cathode 52 connected to the other end of its respective control coil. Typical SCR operation is such that the SCR presents a very high impedance across its anode and cathode terminals until a gating or control voltage is applied to its gate terminal 54 when its anode is positive with respect to its cathode thereby causing the SCR to fire or become fully conductive. A control circuit means generally designated by the numeral 56 in FIG. 1 supplies the gating voltages at the proper time as described in further detail hereinbelow. When an SCR is fully conductive, a very low impedance exists between the anode and cathode and as used in the apparatus 10 functions for all intents and purposes as a short-circuit. Although an SCR is illustrated in FIG. 1, any controllable short-circuiting device such as a triac or transistor may be used.

The control circuit 56 is arranged in FIG. 1 to sense variations in the output voltage applied across a load 14. The output voltage is fed back to the control circuit means 56 by leads 64, 66 which are connected to the secondary winding terminals 28, 30. The control circuit 56 is responsive to the sensed variations to control the power transfer to maintain the output voltage at a desired magnitude.

The control coils 38, 40, 42 function as reactive chokes when open-circuited, that is, the magnetic field created in the control cores 32, 34, 36 develops a counter electromotive force that opposes the flow of current in the primary winding 20, thereby limiting the magnitude of the transferred power. The control cores 32, 34, 36 contain sufficient amounts of magnetic material and cross-sectional area to provide enough reactance to achieve essentially complete choking without saturation. Power transfer control and voltage regulation is achieved by selectively and sequentially short-circuiting and open-circuiting the control coils 38, 40, 42 to provide a constant induced voltage across the secondary winding 26 and the load 14.

In the illustrated example shown in FIG. 1, the control circuit 56 senses the output voltage across the load 14. When the power source voltage applied across primary terminals 22, 24 drops, the voltage induced across the secondary winding 26 will also drop, because the magnetic field created in the power core 18 is less intense because of the lower source voltage which in turn induces a lower voltage across the secondary winding 26. The control circuit 56 senses the drop in the power transfer and selectively short-circuits one or more of the control coils 38, 40, 42 for a predetermined time in response to the sensed change in the output voltage. Short-circuiting a control coil removes its choking effect and allows more current to flow in the primary winding 20. The higher amount of current flowing in the primary winding 20 develops a more intense magnetic field in the power core 18 and accordingly, a greater induced voltage across secondary winding 26 thereby maintaining the output voltage at a desired level.

If the voltage magnitude provided by the power source 12 rises above the nominal level, a voltage higher than the desired level is induced across the secondary winding 26 and accordingly the load 14 connected to terminals 28, 30. The control circuit 56 senses the increased voltage across the secondary winding 26 and delays the short-circuiting of the control coils 38, 40, 42 to prolong the choking effect to lower the induced voltage across the secondary winding 26. The timing of the short-circuiting and open-circuiting of the control coils to produce a choking reactance to control the power transfer is described in more detail hereinbelow.

The turns ratio of a control coil to a primary coil may be designed to accommodate less expensive short-circuiting switching devices having lower voltage ratings and characteristics. For example, short-circuiting devices having a lower rated peak inverse voltage may be used by constructing a control coil having a fewer number of turns of a larger conductor. The control coil is generally designed to have approximately the same ampere turn capacity as the primary winding 20 so that the current flow in the control coil is not required to rise to a significant level to load its associated control core. A limited current flow in the control coil is possible because the voltage induced across the control coil drops to the value needed to overcome the small DC resistance of the control coil itself and that of the short-circuiting device connected across the control coil. The limited current only flows through the small DC resistance existing in the control coil and the short-circuiting device during conduction. Additionally, the control cores 32, 34, 36 are designed to create the inductance required to obtain the amount of reactance necessary to realize complete power transfer control. Consequently, only small amounts of power are consumed to achieve efficient power transfer and output voltage regulation.

Still referring to FIG. 1, resistors 58, 60, 62 are connected in parallel with their respective control coils 38, 40, 42 and associated SCR's 44, 46, 48. Each resistor functions to buffer residual flux that exists in the control core associated with the control coil in parallel with the resistor. Buffering the residual flux in the control core prevents distortion in the transferred power waveform.

Each control coil 38, 40, 42 and its associated control core 32, 34, 36 respectively are designed to provide a choking reactance which controls the power transfer over a limited range. By sequentially short-circuiting and open-circuiting the control coils as required, an additive effect is realized in the induced voltage across the secondary winding 26 to achieve output voltage regulation over a wide range of power source voltage variations.

The choking reactance of each control coil is at a maximum when the coil is open-circuited to provide a minimum power transfer. Each control coil and its associated SCR operate along a predetermined timing ramp which is generated by the control circuit 56. Each of the SCR's 44, 46, 48 is brought into conduction at any point along its control timing ramp to provide a variable range of control to maintain a high degree of output voltage regulation. By timing the individual control ramps to follow one another, a composite cascaded control timing ramp is effectuated over which a continuous range of power transfer control and output voltage regulation is realized.

Figure 6A:
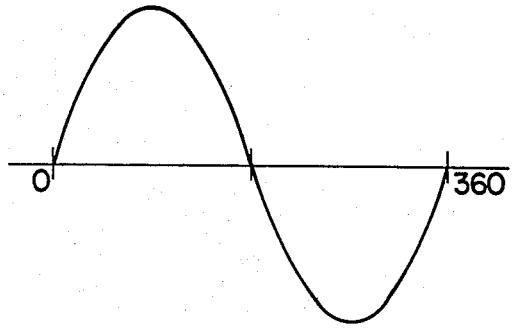

Referring now to FIGS. 1 and 6*a–g*, FIGS. 6*a–g* show graphical representations of voltage, current and timing waveforms at various points in the circuitry of FIG. 1. A typical 60 Hertz, commercial 110 volt input power source voltage waveform is shown in FIG. 6*a*.

Figure 6B:
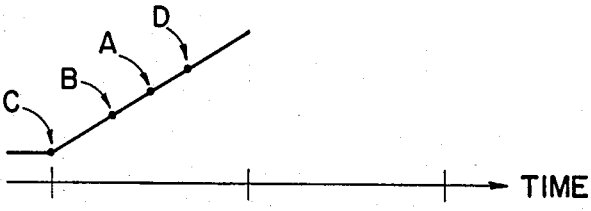
Figure 6C:
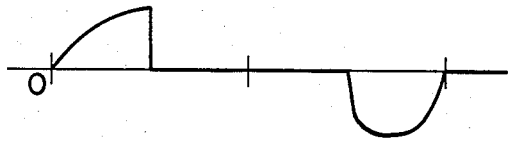

For explanation purposes, a composite control timing ramp comprised of the individual short-circuiting devices control ramps cascaded together is shown in FIG. 6*b*. Further assume that point A represents the position in time on the timing control ramp at which the voltage provided to a load connected across the secondary winding 26 is equal to the input power source nominal voltage level applied across the primary winding 20. The control circuit 56 senses that the voltage across the secondary winding 26 is at the desired magnitude, and consequently delays increasing the power transfer until point A is reached on the control timing ramp. When point A is reached, the control circuit 56 provides a voltage pulse to gate terminal 54 of SCR 44 to cause the SCR to become conductive. When SCR 44 becomes conductive, the voltage across control coil 38 drops to a low value while the control coil current rises to a higher value to load the control core 32. FIG. 6*c* is a graphical representation of the voltage across the control coil 38. The counter electromotive force provided by control core 32 disappears when control coil 38 is short-circuited allowing a greater amount of power to be transferred. It will be noted that even though SCR 44 is a unilaterally conducting device and operates in only one-half of an alternating current electrical cycle, the demagnetization of control core 32 in the second half of the alternating current cycle will produce an output wave of the opposite polarity affording essentially full wave control.

During the interval from point A to point B along the control timing ramp, the two remaining control cores 34, 36 and coils 40, 42 respectively function as reactive chokes to provide a counter electromotive force that opposes the flow of current in the primary winding 20. If the control circuit 56 senses that it is necessary to transfer more power to maintain the voltage across a load at the desired level to compensate for an increase in load or variation in the input power source voltage mangitude, it may, for example, at point D provide a voltage pulse to gate terminal 54 of SCR 46 to cause the SCR to become conductive. When SCR 46 becomes conductive, the voltage across control coil 40 drops to a low value while the control coil current rises to a higher value to load its control core 34. The counter electromotive force provided by control core 34 now disappears allowing a greater amount of power to be transferred to the secondary winding 26. By controlling the ratio of time for the choking and loading conditions of operation, the output voltage magnitude is maintained at a desired level.

If the input power source voltage drops, for example, to the lower limit for which control is designed, then each SCR 44, 46, 48 will be gated into conduction at the beginning at its associated control timing ramp to provide a maximum duration loading of each associated control core 38, 40, 42 to allow maximum transfer of power from the primary winding 20 to the secondary winding 26 to maintain the secondary voltage at the desired level. The control circuit 56 senses that the output voltage has dropped below the desired value and determines the amount of additional power to be transferred to restore the voltage across the secondary winding 26 to the desired level.

Figure 6D:
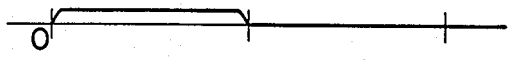

To provide maximum power transfer, the control circuit 56 generates a voltage pulse to the gate terminal 54 of SCR 44 to short circuit control coil 38 at the beginning of the control timing ramp generally designated at point C in FIG. 6*b*. The voltage appearing across the control coil 38 is the voltage drop across the SCR 44 and is shown in FIG. 6*d*.

Figure 6E:
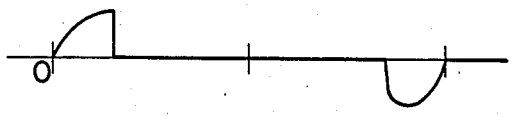

At the end of the control timing ramp associated with the control coil 38, the control circuit 56 senses the output voltage. If the output voltage magnitude is still below the desired level, the control circuit 56 provides a gating pulse to the gate terminal 54 of SCR 46 causing that SCR to become conductive and short-circuit control coil 40. The gating pulse is provided to SCR 46 at point B along the control timing ramp illustrated in FIG. 6*b*. FIG. 6*e* represents the voltage across control coil 40.

Figure 6F:
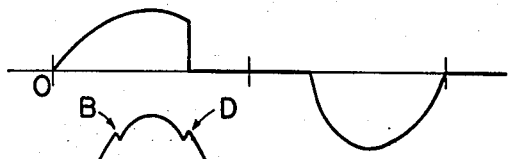

At the end of the control timing ramp associated with the control coil 40, the control circuit 56 senses the output voltage to determine whether or not the output voltage is at the desired level. If the output voltage magnitude is still not at the desired level, then the control circuit 56 provides a gating pulse at the proper time, generally designated at point D in FIG. 6*b*, to gate 54 of SCR 48 to bring the SCR into conduction to short-circuit control coil 42. FIG. 6*f* shows the control coil 42 voltage.

Figure 6G:
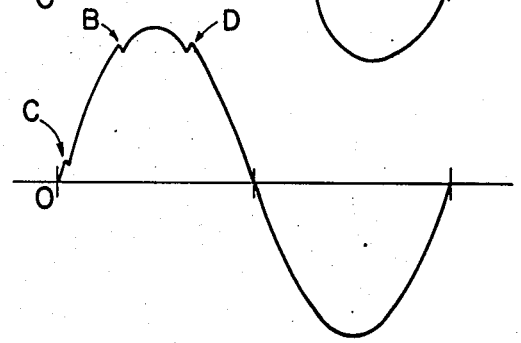

The resultant output voltage waveshape across the secondary winding 26 is shown in FIG. 6*g*. The output voltage includes the additional power transferred during the alternating current cycle to bring the output voltage magnitude to the desired level while preserving the input power source voltage waveshape. The times correlating to points B, C and D on the control timing ramp in FIG. 6*b* at which additional power is transferred appear in FIG. 6*g* at points B, C and D, respectively and have been exaggerated to better show their location.

Although three control coils and associated control cores are illustrated in FIG. 1, additional control coils and associated control cores may be provided to extend the range of power transfer control and to compensate for greater variations in the input power source voltage to maintain a desired output voltage magnitude without distorting or degrading the input power waveshape.

Figure 3:
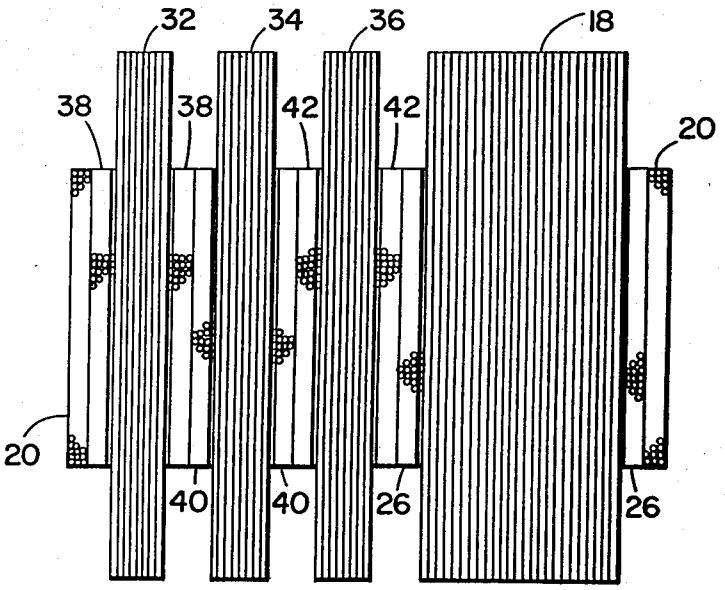
FIG. 3 is a cross-sectional view of the power transferring device of FIG. 2 taken along the line 3—3.

Additionally, each of the control cores illustrated in FIGS. 2 and 3 have identical cross-sectional areas or volumes such that each control core provides a substantially equal response and amount of reactance to control the power transfer. In some instances as explained hereinbelow, the control cores are proportioned to provide for overlapping control timing ramps to achieve a higher degree of regulation and a more responsive power transfer control.

Figure 4:
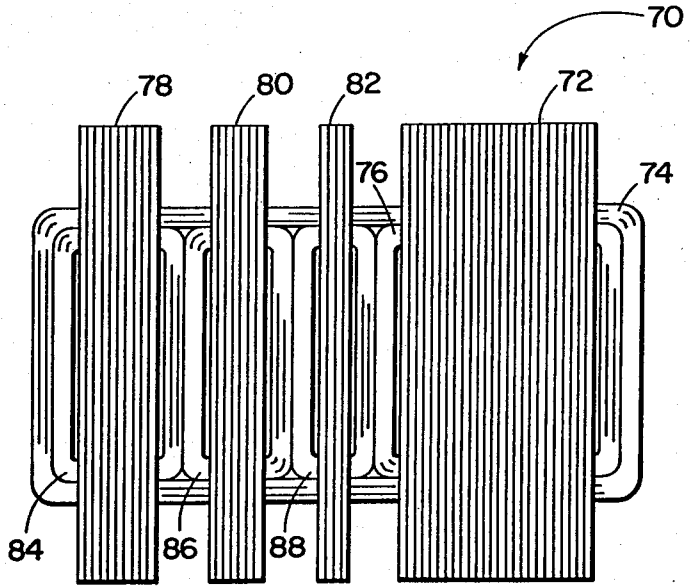
FIG. 4 is a top plan view of another embodiment of the power transferring device wherein the control cores have proportioned cross-sectional areas.

Referring now to FIG. 4, a top plan view of another power transferring device embodying the present invention and generally designated by the numeral 70 is shown wherein the control cores are proportioned. The power transferring device 70 includes a power core 72, a primary coil 74 and a secondary coil 76 encircling the power core 72 to form a conventional transformer. The device 70 further includes a number of control cores 78, 80, 82 and associated control coils 84, 86, 88 respectively which are encircled by the primary coil 74. By selectively subjecting the primary coil 74 to a controlled reactance produced by the control coils and cores, the amount of power that is transferred is controlled.

The control cores 78, 80, 82 and coils 84, 86, 88 respectively are proportioned relative to each other so that the larger core 78 and coil 84 provides a greater amount of reactance than each of the remaining control cores and coils and accordingly provides a greater range of choking and loading action to influence the power transfer. Because the control cores and coils are made progressively smaller, each core and associated coil provides a smaller degree of choking and loading action to influence the power transfer. By overlapping the end of a control timing ramp associated with one control core and coil with the start of a control timing ramp associated with another control core and coil, variations in the output voltage due to source power voltage magnitude and load variations are more smoothly and substantially instantaneously compensated for.

Turning now to FIG. 5, another embodiment of a control power transferring apparatus in accordance with the present invention is shown in partially schematic form and partially in block diagram form and is designated generally by the numeral 90. The apparatus 90 is responsive to a control signal from an external device or sensor. Unlike the self-regulating power transferring apparatus described in FIG. 1, the power transferring apparatus 90 of FIG. 5 is responsive to a control signal such as, for example, one generated from a device which is to be powered. Such a device might, for example, be an induction furnace wherein the temperature is sensed and the transferred power is regulated in response to a control signal developed by the temperature sensor to cause the output voltage to increase or decrease to maintain a desired temperature.

The apparatus 90 shown in FIG. 5 includes a power transferring device 70 constructed in accordance with the present invention as described in conjunction with FIG. 4. The primary coil 74 is connected to an alternating current electric power source 92 by leads 94,96. The secondary coil 76 is connected by leads 100,102 to a load 98 to be powered. One side of each control coil 84, 86, 88 is connected to a ground reference potential by lead 104. Lead 104 also connects the cathode terminal 106 of SCR 108, 110, 112 respectively to ground. The anode terminal 114 of each SCR 108, 110, 112 is connected to the other side of its associated control coil 80, 84, 88 respectively. A control circuit shown generally by the numeral 116 is responsive to a sensed control signal and provides a voltage pulse at the proper time to the gate terminal 118 of SCR 108, 110, 112 to cause each SCR to become conductive and short circuit its associated control coil 80, 84, 88 respectively to produce the controlled reactance necessary to control the power transferred to the load 98.

The control circuit 116 of FIG. 5 operates generally as follows. When power source 92 is connected to the primary coil 74, a control signal conditioner 120 senses the load voltage or current signal carried on lead 122 and sets the gain and range of the control voltage at its output on lead 124. The control voltage on lead 124 is fed to one input of a number of comparators 126, 128, 130 through associated variable resistances 132, 134, 136 each resistance being in series with the one input of each comparator respectively. The variable resistances 132, 134, 136 are adjusted to set the switching times of each comparator 126, 128, 130 respectively, as shown and described in conjunction with FIG. 8, so that each associated SCR 108, 110, 112 will become conductive at the proper time by a gating voltage generated by the corresponding comparator outputs 138, 140, 142. A zero crossing detector 144 senses the positive transition of the AC voltage input and causes a ramp generator 146 to produce a positive going ramp voltage signal which is fed to the other input of each comparator 126, 128, 130 via lead 148.

Considering now FIG. 8 and the apparatus of FIG. 5, FIG. 8 shows control timing ramps generally designated A, B, C produced during the positive half of an alternating current cycle by the control circuit 116 of FIG. 5. Ramps A, B and C are associated with SCR's 108, 110, and 112 respectively. The SCR's 108, 110 and 112 can be triggered sequentially by offsetting the associated SCR control timing ramps relative to the control voltage produced by the control signal conditioner 120. For example, adjusting variable resistances 132, 134 and 136 to provide the offset voltages indicated generally by the letters D, E and F causes the timing ramps A, B and C to move relative to one another and may be set to cause the end of one ramp to overlap the beginning of another ramp. The range over which power transfer can be controlled is established by the difference between the offset voltage D setting for ramp C and the end of ramp A.

When the control voltage present at a comparator input exceeds the voltage set by its associated series variable resistance 132, 134, 136 that comparator 126, 128, 130 provides a gating voltage pulse to turn on its respectively associated SCR 108, 110, 112. For example, if the control voltage is at a magnitude generally indicated by broken line G in FIG. 8, SCR 108 conducts earlier in the alternating current positive half cycle to short-circuit control coil 86 to allow more power to be transferred because of the removal of the choking reactance associated with the control coil 86 and core 80. Because the end of ramp B overlaps with the beginning of ramp A, SCR 110 conducts at a later time during the positive half cycle to short-circuit control coil 84 which allows additional power to be transferred. SCR 112 remains non-conductive so that its corresponding control coil remains open-circuited to provide choking reactance.

As the control voltage drops, for example, to a level indicated by the broken line H in FIG. 8, SCR's 108 and 110 conduct for the full half cycle and SCR 112 conducts only for a portion of the cycle to short-circuit control coil 88. It will be seen that continuous control and a high degree of regulation may be had from the power transferring apparatus of the present invention.

The power transferring device of the present invention, generally designated by the numeral 150 in FIG. 7, may also be arranged to provide a number of different output voltages by using a multiple of secondary windings 152, 154, 156. The arangement shown permits regulation of several different voltages which might be used, for example, with a device requiring one voltage for lights, another voltage for circuitry and a third for operating a motor or other like device. The power transferring device 150 operates in the same manner as the hereinabove described power transferring devices constructed in accordance with the present invention. When multiple secondary windings are employed, the secondary winding associated with the heaviest load is used for sensing load variations.

Tests have shown that the most efficient power transfer is generally obtained when the cross-sectional area or volume of the power core is 1.5 times the sum of the cross-sectional area or volume of the control cores. In the illustrated embodiment depicted in FIG. 2, the power core 18 cross-sectional area is 1.5 times the sum of control cores 32, 34, 36 cross-sectional areas. The 1.5 ratio of power core cross-sectional area to the sum of control core cross-sectional areas is independent of the number of control cores and whether or not the control cores are proportioned relative to one another.

Apparatus for controlling the power transfer from a power source to a load without distorting or degrading the output voltage waveshape has been described in several embodiments, however, numerous modifications and changes may be had without departing from the spirit of the invention.

I claim:

1. Apparatus for controlling the power transfer in an electrical induction device having a plurality of coils arranged to induce an electrical current in a first coil when an electrical potential is impressed across a second coil wherein the waveshape of the transferred electrical power is maintained across the first coil without distortion and degradation, said apparatus comprising:

means for sensing the electrical power transferred to said first coil;

means for providing a reactance, and means responsive to said sensing means for selectively coupling said reactance means to said second coil to control the electrical power transferred to said first coil;

said electrical induction device including a power transformer having a power core and said first coil and said second coil encircling said power core, one of said first and said second coils being arranged to be connected to a source of alternating current electrical power and the other of said first and said second coils being arranged to be connected to a load, and, said reactance means including other of said plurality of coils, said other coils being control coils and said reactance means further including a plurality of cores of which each core is associated with a single control coil which coil encircles its associated core and one of said first and said second coils further being arranged to encircle said plurality of control cores and coils and the other of said first and second coils such that said coil connected to the power source is coupled to the choking reactance of said plurality of control cores and coils.

2. Apparatus for controlling the power transfer in an electrical induction device as defined in claim 1 wherein said apparatus further comprises controllable switching means for selectively short-circuiting and open-circuiting said plurality of control coils during each alternating current electrical cycle in response to a control signal generated by said responsive means to control the time said power connected coil is coupled to the choking reactance of said plurality of control cores and coils.

3. Apparatus for controlling the power transfer in an electrical induction device as defined in claim 2 wherein the volume of each control core relative to one another and to the power core is a predetermined relationship such that the amount of reactance provided by a control core and coil is proportional to the volume of the control core.

4. Apparatus for controlling the power transfer in an electrical induction device as defined in claim 3 wherein the volume of each control core is the same so that each control core and coil of said plurality provides substantially equal amounts of reactance for controlling the power transfer from said power connected coil to said load connected coil.

5. Apparatus for controlling the power transfer in an electrical induction device as defined in claim 3 wherein the volume of each control core is made proportionally smaller such that each control core and coil provide proportionally smaller amounts of reactance for controlling the power transfer from said power connected coil to said load connected coil.

6. Apparatus for controlling the power transfer in an electrical induction device as defined in claim 2 wherein said responsive means provides a control signal to said controllable switching means so that said plurality of control coils are sequentially open-circuited and short-circuited to provide continuous control and undistorted power transfer.

7. In a power transferring device having a plurality of windings having one winding arranged for connection to means acting as a source of alternating current electric power and arranged for connection to means forming a load, wherein said device is arranged to control the power transferred to a load under varying source power conditions and varying load conditions without distorting and degrading the alternating current electric waveform, said device comprising:

means for sensing power transferred to a load;

means for providing a reactance, and means responsive to said sensing means for controlling the power transfer between said power source and said load;

said power transferring device further including a power core wherein said plurality of windings encircle the power core and said reactance means comprises a plurality of control windings separate from the power core and each of said plurality of control windings being selectively open-circuited and short-circuited to produce a controlled reactance wherein at least one of said plurality of control windings includes an associated control core;

wherein one and only one of said plurality of windings encircling the power core is arranged to encircle said plurality of control windings and associated control cores for subjecting said encircling winding to the controlled reactance of said plurality of control windings.

8. In a power transferring device as defined in claim 7 wherein said plurality of control windings and associated control cores are arranged to selectively subject said encircling winding to choking reactance without control core saturation when said control core associated control winding is open-circuited and short-circuited.

9. In a power transferring device as defined in claim 7 wherein said responsive means includes control means for selectively short-circuiting and open-circuiting said control windings during an alternating current electric power cycle.

10. In a power transferring device as defined in claim 7 wherein each of said plurality of control windings includes an associated control core, each of said control cores having a predetermined cross-sectional area.

11. A self-regulating power transferring device having a plurality of windings coupled to a power core and having one winding arranged for connection to means acting as a source of alternating current electric power and another arranged for connection to means forming a load, wherein said device is arranged to regulate the alternating current electric power delivered to a load under varying source power conditions and varying load condition without distorting and degrading the alternating current electric waveform, said device comprising:

means for sensing the magnitude of the alternating current electrical power delivered to a load;

means for providing a reactance, and means responsive to said sensing means for selectively coupling said reactance means to the power core to control the power transfer between said at least one of said plurality of windings connected to said electric power source and at least one of other of said plurality of windings connected to said load;

wherein said plurality of windings encircle the power core and said reactance means comprises a plurality of control windings separate from the power core and each of said plurality of control windings has an associated control core wherein each control winding is selectively open-circuited and short-circuited to produce a controlled reactance without saturation of said associated control core;

wherein one and only one of said plurality of windings encircling the power core is arranged to encircle said plurality of control windings and associated control cores and the power core for subjecting said encircling winding to the controlled reactance of said plurality of control windings.

12. A self-regulating power transferring device as defined in claim 11 wherein said plurality of control windings and associated control cores are arranged to selectively subject said encircling winding to choking reactance without control core saturation when said control core associated control winding is open-circuited and short-circuited.

* * * * *